US005769168A

United States Patent [19]

Skiba

[11] Patent Number: 5,769,168

[45] Date of Patent: Jun. 23, 1998

[54] BLADE TILT ANGLE LIMITING FUNCTION FOR A BULLDOZER

[75] Inventor: Richard J. Skiba, Peoria, Ill.

[73] Assignee: Caterpillar Inc., Peoria, Ill.

[21] Appl. No.: 708,525

[22] Filed: Sep. 5, 1996

[51] Int. Cl.[6] ..... E02F 3/76

[52] U.S. Cl. ..... 172/4.5; 172/826; 364/424.07

[58] Field of Search ..... 172/4, 4.5, 811, 172/812, 826; 36/348, 382, 414; 414/687, 697, 698, 699; 364/167.01, 424.07

[56] References Cited

U.S. PATENT DOCUMENTS

| | | | |
|---|---|---|---|
| 5,088,020 | 2/1992 | Nishida et al. | 364/160 |
| 5,462,125 | 10/1995 | Stratton et al. | 172/826 |
| 5,467,829 | 11/1995 | Barton et al. | 172/4.5 |
| 5,499,684 | 3/1996 | Stratton | 172/4.5 |
| 5,551,518 | 9/1996 | Stratton | 172/4.5 |

*Primary Examiner*—Michael J. Carone
*Assistant Examiner*—Robert Pezzuto
*Attorney, Agent, or Firm*—David M. Masterson

[57] ABSTRACT

A control system regulated the tilt of an implement of an earlier working machine. Fluid operated lift and tilt cylinders are connected to the implement. Hydraulic control valves deliver pressurized hydraulic fluid to the lift and tilt cylinders. A control lever produces an implement tilt command signal in response to position of the control lever. A controller receives the implement tilt command signal and responsively delivers an implement tilt control signal to the hydraulic valves to cause pressurized fluid flow to actuate at least one of the lift and tilt cylinders to tilt the implement. First and second displacement sensors produce first and second position signals indicative of the extension of the respective lift cylinders. The controller receives the first and second position signals, determines a magnitude of the difference between the relative positions of the first and second lift cylinders, compares the magnitude difference to a maximum differential value, and stops the delivery of the implement tilt control signal in response to the magnitude difference being substantially equal to the maximum differential value.

5 Claims, 3 Drawing Sheets

BLADE TILT ANGLE LIMITING FUNCTION FOR A BULLDOZER

TECHNICAL FIELD

This invention relates to a control system for a bulldozer blade and more particularly to a control system for limiting the tilting angle of the bulldozer blade.

BACKGROUND ART

Systems for controlling the position of a blade of a bulldozer have been utilized for decades. Typically, the control system enables a vehicle operator, to control the lifting, tilting, and tipping of the blade by way of a fluid operated system. Because such systems are manually controlled (requires good hand-eye coordination) the accuracy and consistency of blade positioning will vary from operator to operator and from time to time. Since a substantial amount of trial and error is required by even the most skilled operator both efficiency and accuracy of operation will suffer.

To tilt the blade to an angle required to obtain the desired slope of cut is difficult for even the most skilled operator. Situations exist where tilting the blade causes the push arms of the bulldozer to collide with the bulldozer tracks. Such a collision may cause substantial damage to both the push arms and track. To prevent such a collision, the machine operator must step down from the operator cab and visually inspect the distance between the push arms and the track to determine if the tilt angle of the blade is not a "danger zone". However, such an inspection takes a substantial amount of operator time that it negatively effects the work productivity of the operator.

The present invention is directed to overcoming one or more of the problems as set forth above.

DISCLOSURE OF THE INVENTION

In one aspect of the present invention, a tilt angle control system for an implement of an earth working machine is disclosed. Fluid operated lift and tilt cylinders are connected to the implement. Hydraulic control valves deliver pressurized hydraulic fluid to the lift and tilt cylinders. A control lever produces an implement tilt command signal in response to position of the control lever. A controller receives the implement tilt command signal and responsively delivers an implement tilt control signal to the hydraulic valves to cause pressurized fluid flow to actuate at least one of the lift and tilt cylinders to tilt the implement. First and second displacement sensors produce first and second position signals indicative of the extension of the respective lift cylinders. The controller receives the first and second position signals, determines a magnitude of the difference between the relative positions of the first and second lift cylinders, compares the magnitude difference to a maximum differential value, and stops the delivery of the implement tilt control signal in response to the magnitude difference being substantially equal to the maximum differential value.

BRIEF DESCRIPTION OF THE DRAWINGS

For a better understanding of the present invention, reference may be made to the accompanying drawings in which.

BEST MODE FOR CARRYING OUT THE INVENTION

Figure 1:
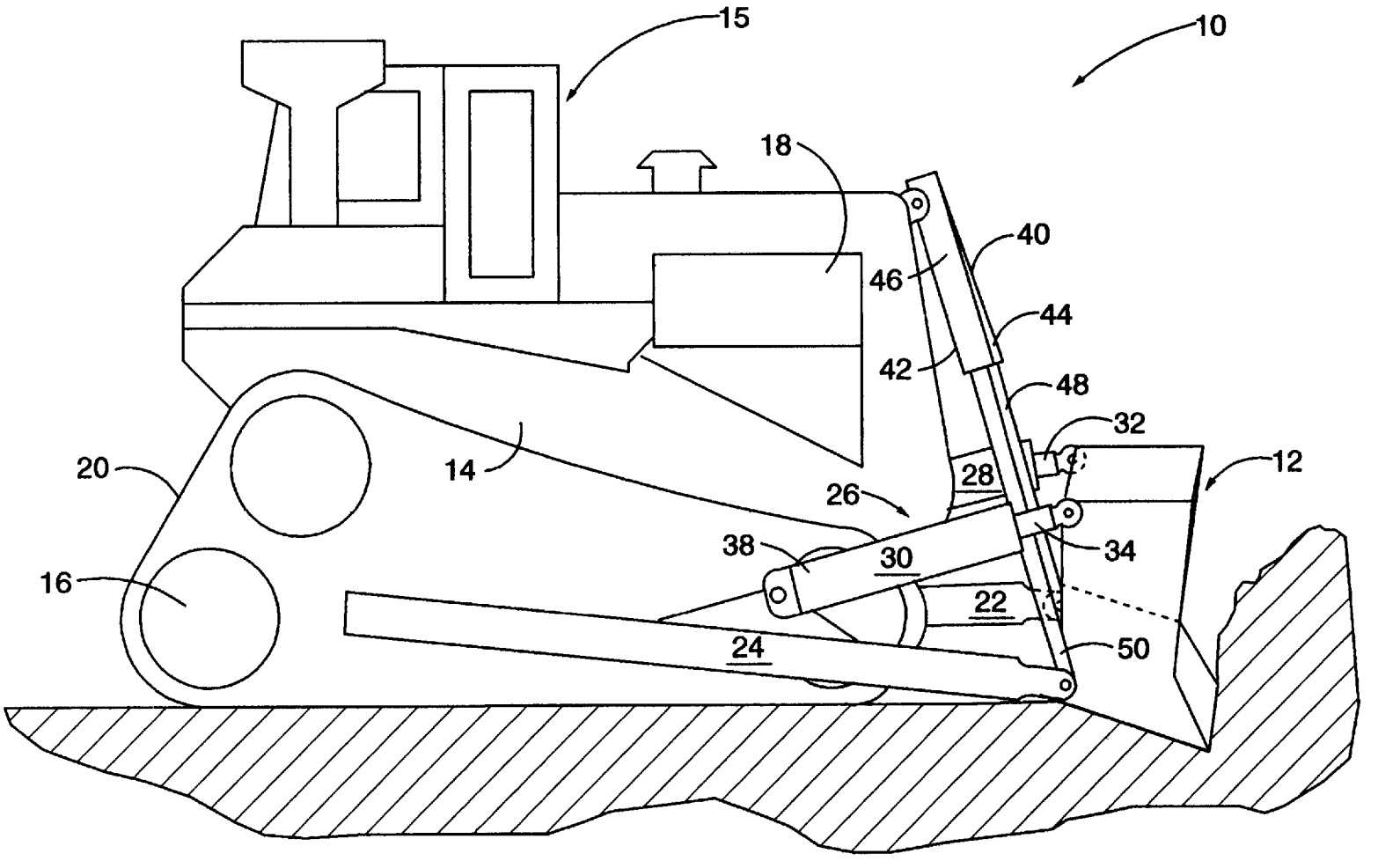
FIG. 1 is a diagrammatic side elevational view of an earth working machine having an implement movably mounted thereon.

The following detailed description of the invention will describe one application of the preferred embodiment of the preferred use on an earth working machine, such as a track type tractor or bulldozer.

The bulldozer 10 has a frame 14, an undercarriage 16 connected to the frame 14, and a prime mover 18 such as an internal combustion engine. The prime mover 18 is drivingly connected to an endless track 20 of the undercarriage 16, in any conventional well known manner. The prime mover rotates the track 20 and propels the machine 10 over the underlying terrain.

First and second spaced apart push arms 22,24 are pivotally connected at opposite ends of the implement 12 and the frame 14, respectively, in a conventional manner. Each push arm is substantially the same length and holds the implement transverse a front end of the machine as viewed from the operators station 30.

Figure 3:
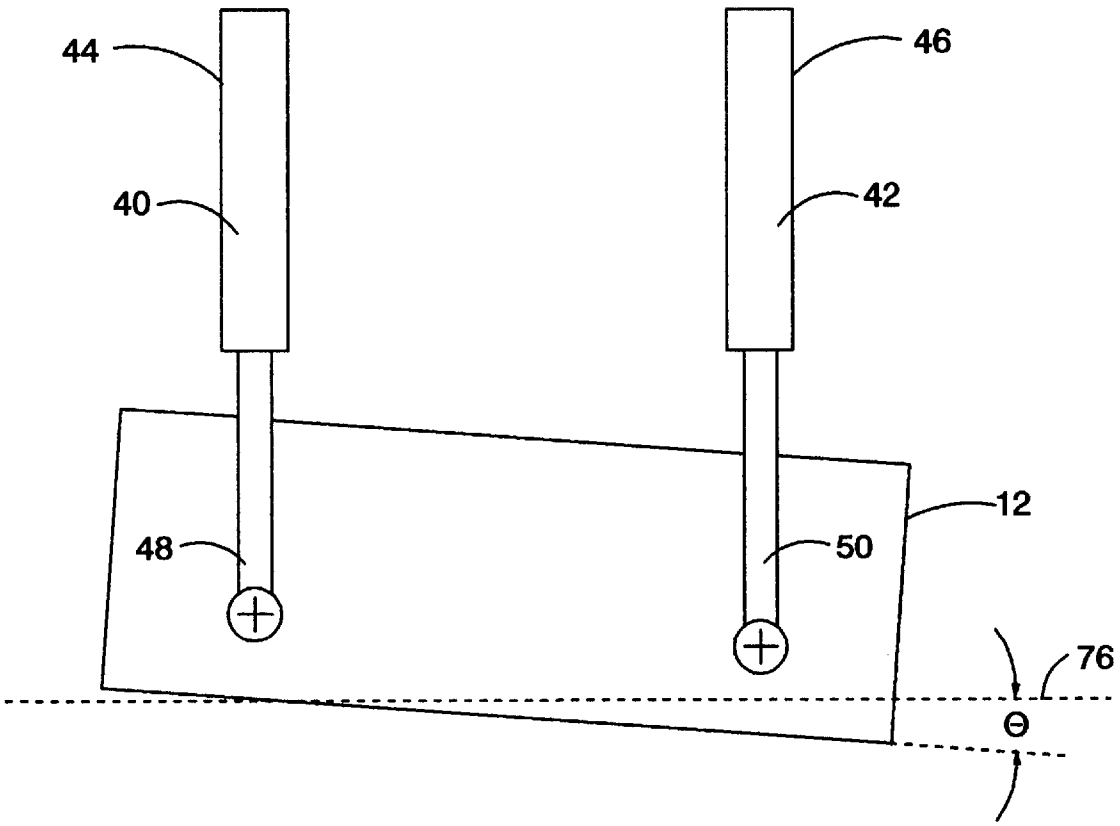
FIG. 3 is an diagrammatic front plan view of the implement relative to a horizontal reference plane.

First and second spaced apart fluid operated extensible tilt cylinders 28,30 are provided for tilting the implement 12 relative to the frame 14 in first and second directions from a base position. The base position is defined as a substantially horizontal position of the implement when the machine 10 is supported on a substantially flat horizontal surface. Extension or retraction of the rod end portion 32,34 of either of the first and second tilt cylinders 28,30 relative to the head end portion 36,38 will cause tilting of the implement 12. In this context, the slope of dozing is controlled by controlling the tilt angle θ of the implement relative a horizontal plane, as shown in FIG. 3. The tilt angle θ as seen from the operators station 30 appears as a relative lowering of either a right or left hand corner of the implement 12.

First and second spaced apart fluid operated lift cylinders 40,42 are provided for elevationally moving the implement relative to the frame 14. Extension or retraction of the rod end portion 48,50 of either of the first and second lift cylinders 40,42 relative to the head end portion 44,46 will cause elevational movement of the implement 12 (about the pivotal connection of the first and second push arms 22,24) relative to the frame 14.

Figure 2:
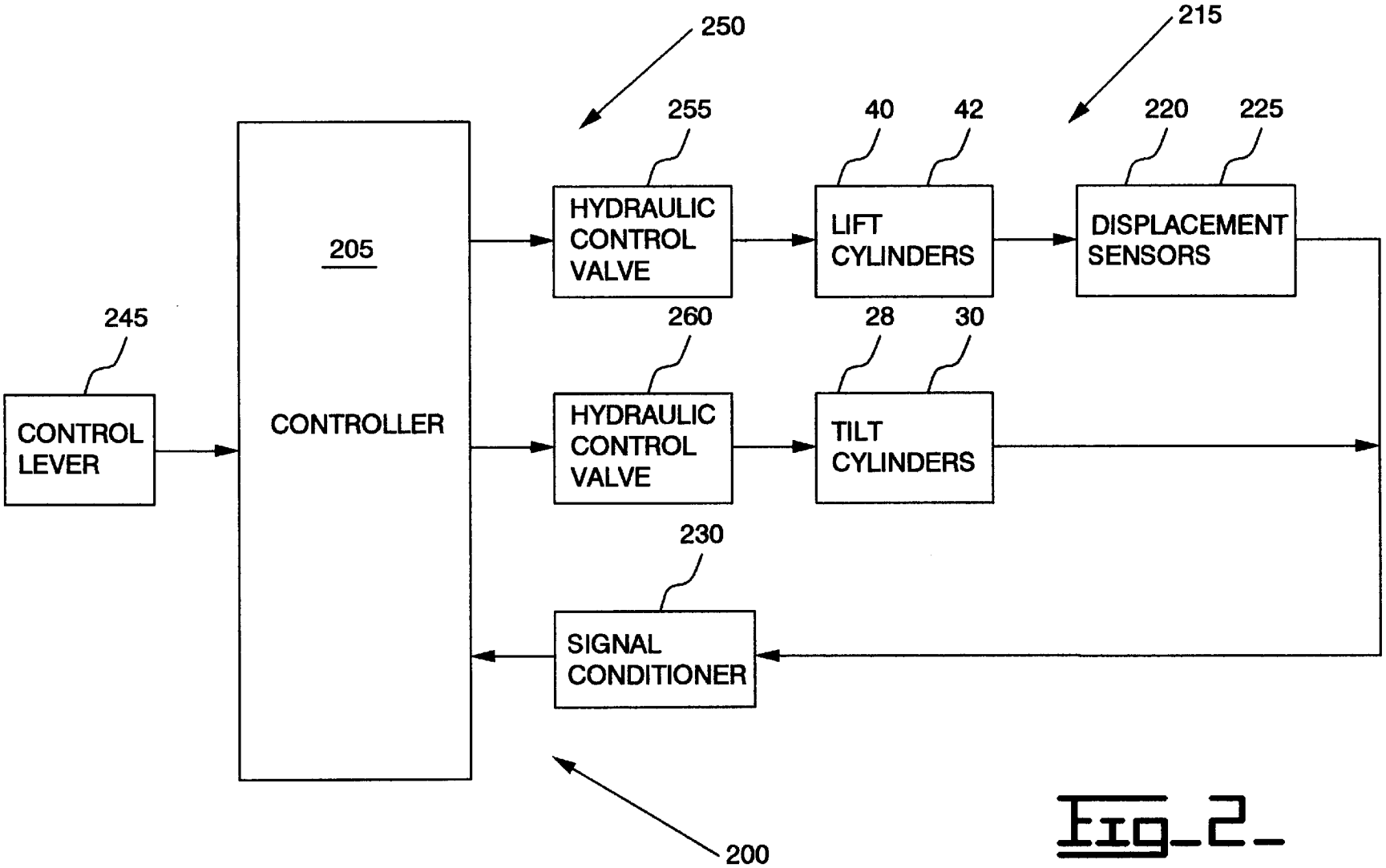
FIG. 2 is a diagrammatic schematic representation of an embodiment of the control system of the present invention.

Referring to FIG. 2, a block diagram of an implement control system 200 associated with the present invention is shown. The control system 200 provides for both automatic and manual control of the implement 12. Preferably, the implement control system includes a microprocessor based controller 205. The controller 205 is adapted to sense a plurality of inputs and responsively produce output signals which are delivered to various hydraulic actuators or cylinders of the control system.

A fluid operated control system 250 includes hydraulic control valves 255,260 which control the flow of hydraulic fluid to the lift and tilt cylinders.

A control lever 245 is provided for the operator to manually control the movement of the implement 12. Preferably, the control lever 245 includes a joystick that is pivotally movable to a plurality of different positions. The joystick delivers a tilt command signal to the controller 205 in response to the pivotal position of the joystick. In response to receiving the tilt command signal, the controller 205 produces a tilt control signal which is delivered a driver circuit of any suitable commercially available type to effect actuation of the hydraulic control valves 255,260 to position the implement at the desired tilt angle. Thus, by the operator positioning the joystick, the left or right tilting of the implement 12 can be controlled.

In addition to manual control of the tilting of the implement 12, semi-automatic control over the tilting of the implement is provided as discussed below.

Position sensing means 215 produces position signals in response to the position of the implement 12. More particularly, the position sensing means 215 includes displacement sensors 220,225 that sense the amount of cylinder extension of the first and second lift cylinders 40,42 and responsively produce first and second position signals in response to the respective cylinder extension or position of the respective lift cylinders 40,42. The displacement sensors 220,225 each preferably include a magnetostrictive sensor of a type well known in the art. A magnetostrictive sensor is a magnetic position responsive device which generates a pulse width modulated (PWM) position signal. In the particular application disclosed herein, the PWM position signals generated by the displacement sensors 220 are proportional to the relative position of the lift cylinders 40,42. It should be noted that other well known devices, for example, a linear variable differential transformer, yo-yo type encoder, potentiometer, or resolver, and an RF signal generator are suitable replacements for the magnetostrictive sensor and within the scope of the invention.

The PWM position signals are delivered to the controller 205 via a signal conditioner circuit 230 which converts the PWM position signals into digital signals for the purpose of further processing. Such signal conditioner circuits are well known in the art. Note that, the signal conditioner circuit 230 may be part of the controller 205 and implemented in software.

The controller 205 may include any appropriate processor suitable for processing the position signals in accordance with preprogrammed instructions and a memory for storing instructions, information, and processed information. The controller 205 determines the magnitude of difference between the relative positions of the first and second lift cylinders 40,42, based on the first and second position signals. The difference D is then compared to a maximum differential value MAX, which is representative of the maximum angle $\theta_L$ that the implement can tilt, either right or left, without the push-arms striking the track.

The difference D is computed as follows:

$D=T_1-T_2$ where:

$T_1$=The magnitude of the extension of the first lift cylinder 40.

$T_2$=The magnitude of the extension of the second lift cylinder 42.

From the difference value D, the implement tilt angle $\theta_T$ may also be computed as follows:

$\theta_T$=Arctan D/DIS where:

DIS=The distance between the first and second lift cylinders 40,42.

The controller 205 then compares the difference D with the maximum differential value MAX (or compares the implement tilt angle $\theta_T$ with a tilt limit angle $\theta_L$). As the difference value D approaches a predetermined range of the maximum differential value MAX (or as the implement tilt angle $\theta_T$ approaches a predetermined range of the tilt limit angle $\theta_L$), the controller 205 produces the tilt control signal with a decreasing magnitude to limit the tilting speed of the implement. Once difference D reaches the maximum differential value MAX (or the implement tilt angle $\theta_T$ reaches the tilt limit angle $\theta^L$), then the controller 205 disables the tilting function by ceasing the production of the tilt control signal.

Thus, while the present invention has been particularly shown and described with reference to the preferred embodiment above, it will be understood by those skilled in the art that various additional embodiments may be contemplated without departing from the spirit and scope of the present invention.

Industrial Applicability

With reference to the drawings, and in operation, the operator may manually control tilting of the implement by way of the control lever 245 as discussed above. Further, the present invention provides for a semi-automatic control by limiting the tilting angle of implement to a tilt angle limit. Thus, the operator may freely tilt the implement without the worry that the push-arms 24 will strike the tracks and cause substantial damage to the machine.

Other aspects, objects and advantages of the present invention can be obtained from a study of the drawings, the disclosure and the appended claims.

I claim:

1. A tilt angle control system for an implement of an earth working machine having a frame, comprising:

first and second fluid operated lift cylinders being connected to the implement;

first and second fluid operated tilt cylinders being connected to the implement, the implement being movable relative to the frame in response to movement of at least one of the lift and tilt cylinders;

hydraulic control valves being adapted to deliver pressurized hydraulic fluid to the lift and tilt cylinders;

a control lever being pivotally movable to a plurality of positions, the control lever producing an implement tilt command signal in response to position of the control lever;

a controller being adapted to receive the implement tilt command signal and responsively deliver an implement tilt control signal to the hydraulic valves to cause pressurized fluid flow to actuate at least one of the lift and tilt cylinders to tilt the implement;

a first displacement sensor being adapted to produce a first position signal indicative of the extension of the first lift cylinder;

a second displacement sensor being adapted to produce a second position signal indicative of the extension of the second lift cylinder; and wherein the controller receives the first and second position signals, determines a magnitude of a difference between the relative positions of the first and second lift cylinders, compares the magnitude difference to a maximum differential value, and stops the delivery of the implement tilt control signal in response to the magnitude difference being within a predetermined range of the maximum differential value, the maximum differential value representing the maximum angle that the implement can tilt without the implement damaging the machine.

2. A tilt angle control system, as set forth in claim 1, wherein the first and second displacement sensors each include a magnetostrictive device being connected to a respective one of the first and second lift cylinders.

3. A tilt angle control system for an implement of an earth working machine having a frame, comprising:

first and second fluid operated lift cylinders being connected to the implement;

first and second fluid operated tilt cylinders being connected to the implement, the implement being movable relative to the frame in response to movement of at least one of the lift and tilt cylinders;

hydraulic control valves being adapted to deliver pressurized hydraulic fluid to the lift and tilt cylinders;

a control lever being pivotally movable to a plurality of positions, the control lever producing an implement tilt command signal in response to position of the control lever;

a controller being adapted to receive the implement tilt command signal and responsively deliver an implement tilt control signal to the hydraulic valves to cause pressurized fluid flow to actuate at least one of the lift and tilt cylinders to tilt the implement;

a first displacement sensor being adapted to produce a first position signal indicative of the extension of the first lift cylinder;

a second displacement sensor being adapted to produce a second position signal indicative of the extension of the second lift cylinder; and wherein the controller receives the first and second position signals, determines a magnitude of a difference between the relative positions of the first and second lift cylinders, calculates a tilt angle of the implement based on the relative difference, compares the calculated tilt angle to a tilt limit angle, and stops the delivery of the implement tilt control signal in response to the calculated tilt angle being substantially the same as the tilt limit angle, the tilt limit angle representing the maximum angle that the implement can tilt without the implement damaging the machine.

4. A tilt angle control method for an implement of an earth working machine having first and second fluid operated lift and tilt cylinders being connected to the implement and hydraulic control valves being adapted to deliver pressurized hydraulic fluid to the lift and tilt cylinders, comprising the steps of:

producing an implement tilt command signal in response to position of a control lever;

receiving the implement tilt command signal and responsively delivering an implement tilt control signal to the hydraulic valves to cause pressurized fluid flow to actuate at least on of the lift and tilt cylinders to tilt the implement;

producing a first position signal indicative of the extension of the first lift cylinder;

producing a second position signal indicative of the extension of the second lift cylinder; and receiving the first and second position signals, determining a magnitude of the difference between the relative positions of the first and second lift cylinders, comparing the magnitude difference to a maximum differential value, and stopping the delivery of the implement tilt control signal in response to the magnitude difference being substantially equal to the maximum differential value, the maximum differential value representing the maximum angle that the implement can tilt without the implement damaging the machine.

5. A tilt angle control method, as set forth in claim 4, including the steps of reducing the magnitude of the implement tilt control signal as the magnitude difference approaches a predetermined range of the maximum differential value.

* * * * *